US005267578A

United States Patent [19]

Brackmann et al.

[11] Patent Number: 5,267,578

[45] Date of Patent: * Dec. 7, 1993

[54] CONTROLLED OPENING OF FIBROUS MATERIALS

[75] Inventors: Warren A. Brackmann; Stanislav M. Snaidr, both of Mississauga; Takeshi Nehyo, Willowdale; Michael H. Sheahan, Whitby, all of Canada

[73] Assignee: Rothmans, Benson & Hedges Inc., North York, Canada

[ * ] Notice: The portion of the term of this patent subsequent to Jan. 14, 2009 has been disclaimed.

[21] Appl. No.: 754,519

[22] Filed: Sep. 4, 1991

Related U.S. Application Data

[62] Division of Ser. No. 556,428, Jul. 24, 1990.

[30] Foreign Application Priority Data

Jul. 27, 1989 [GB] United Kingdom ..... 8917182.1
Aug. 16, 1989 [GB] United Kingdom ..... 8918705.8

[51] Int. Cl.[5] ..... A24C 5/00
[52] U.S. Cl. ..... 131/109.1; 131/108
[58] Field of Search ..... 131/109.1, 108

[56] References Cited

U.S. PATENT DOCUMENTS

| | | | |
|---|---|---|---|
| 2,841,154 | 7/1958 | Dearsley | 131/109.1 |
| 4,121,596 | 10/1978 | Labbe | 131/109.1 |
| 4,330,001 | 5/1982 | Hodsall | 131/109.1 |
| 4,526,182 | 7/1985 | Labbe | 131/109.1 |

*Primary Examiner*—V. Millin
*Assistant Examiner*—J. Doyle

[57] ABSTRACT

Fibrous materials are opened from a metered flow thereof using an opening roller and are subjected to a controlled and adjustable further opening operation to input desirable properties to the fibers. The invention is particularly described with respect to cut tobacco fibers and glass fibers.

8 Claims, 2 Drawing Sheets

CONTROLLED OPENING OF FIBROUS MATERIALS

This application is a division of U.S. patent application Ser. No. 556,428 filed Jul. 24, 1990.

FIELD OF INVENTION

The present invention relates to the controlled opening of fibrous materials, particularly cut tobacco in the formation of tobacco filler rods for incorporation into cigarettes.

BACKGROUND TO THE INVENTION

Tobacco in cigarettes comprises a wide variety of particle sizes, including a significant proportion of tiny tobacco particles, which do not contribute in any way to the firmness of the cigarette, although they do make smoke, tar and nicotine. The amount of such small particles may be as high as 5 to 10 percent of the tobacco in the cigarette.

These small particles arise as a result of degradation of the tobacco during processing of the tobacco by repeated opening of tobacco and the use of refusing drums, combs and pickers and similar steps that mechanically abrade the tobacco.

In addition, cigarette filler varies from country to country, factory to factory and from blend to blend in a given factory. With all traditional cigarette making machines, all portions of the blend are subjected to the same opening action, whether needed or not. This leads to unnecessary degradation of the tobacco.

SUMMARY OF INVENTION

The present invention is directed towards decreasing the quantity of short tobacco in filler rods to provide a filling power improvement for the advantages of cigarette firmness, end stability and ember retention while introducing no disadvantages, such as chemical change or taste. In the present invention, a controlled and adjustable opening of the tobacco is effected which selectively affects an individually-variable proportion of longer tobacco particles. The tobacco is fed from the hopper to rod formation without any refuser mechanism which otherwise degrades the whole tobacco mass.

By providing for an adjustable opening of the tobacco from the hopper, opening of tobacco may be adjusted to suit individual blends and the manufacturers preferred compromise between openness (which affects the standard deviation of individual weights) and particle size degradation (which affects cigarette firmness).

The principles of the present invention are not limited to the controlled opening of tobacco in filler rod formation, but rather are applicable to any circumstance where a fibrous mass requires opening to separate the fibrous particles one from another. One such application is to the opening of a metered flow of glass fibers. Such opening also may be accompanied by controlled degradation, for example, in the case of cut tobacco.

Accordingly, in one aspect, the present invention provides a method for opening fibrous material, which comprises metering fibrous material from a source thereof, opening the metered flow of fibrous material to effect substantially complete separation of the fibrous one from another, and subjecting a selected portion only of the opened fibrous material to a further opening operation.

The present invention also includes apparatus for carrying out the method of the invention. In accordance with a further aspect of the present invention, there is provided, therefor, apparatus for opening fibrous material, which comprises reservoir means for holding a mass of fibrous material; a pair of metering rollers located adjacent an open lower end of the reservoir means for metering a flow of the fibrous material from the lower end of the reservoir means; opening roller means located in operative relationship with the pair of metering rollers to effect opening of the metered flow of fibrous material to separate the fibers substantially completely one from another; and selected additional opening means located in operative relationship with the opening roller means to effect a further opening on a selected portion only of said opened fibrous material.

GENERAL DESCRIPTION OF INVENTION

There has previously been described in U.S. Pat. No. 4,867,180, the disclosure of which is incorporated herein by reference, a novel cigarette making machine utilizing a so-called "flow-through" hopper, whereby all tobacco contained in the hopper is forwarded to rod formation without any refuser mechanism. As described therein, the hopper is equipped with a pair of metering rollers at the lower end thereof to meter tobacco from the hopper and an opening roller which separates the metered tobacco into individual particles which are received on a transportation device which conveys the tobacco to rod formation. In one embodiment of the present invention, this structure is modified to provide controlled adjustable opening of the tobacco from the hopper to degrade only longer particles while smaller particles are unaffected, so as to produce, overall as compared to conventional tobacco processing procedures, a less degraded tobacco mass having improved filling power.

DESCRIPTION OF PREFERRED EMBODIMENTS

Figure 1:
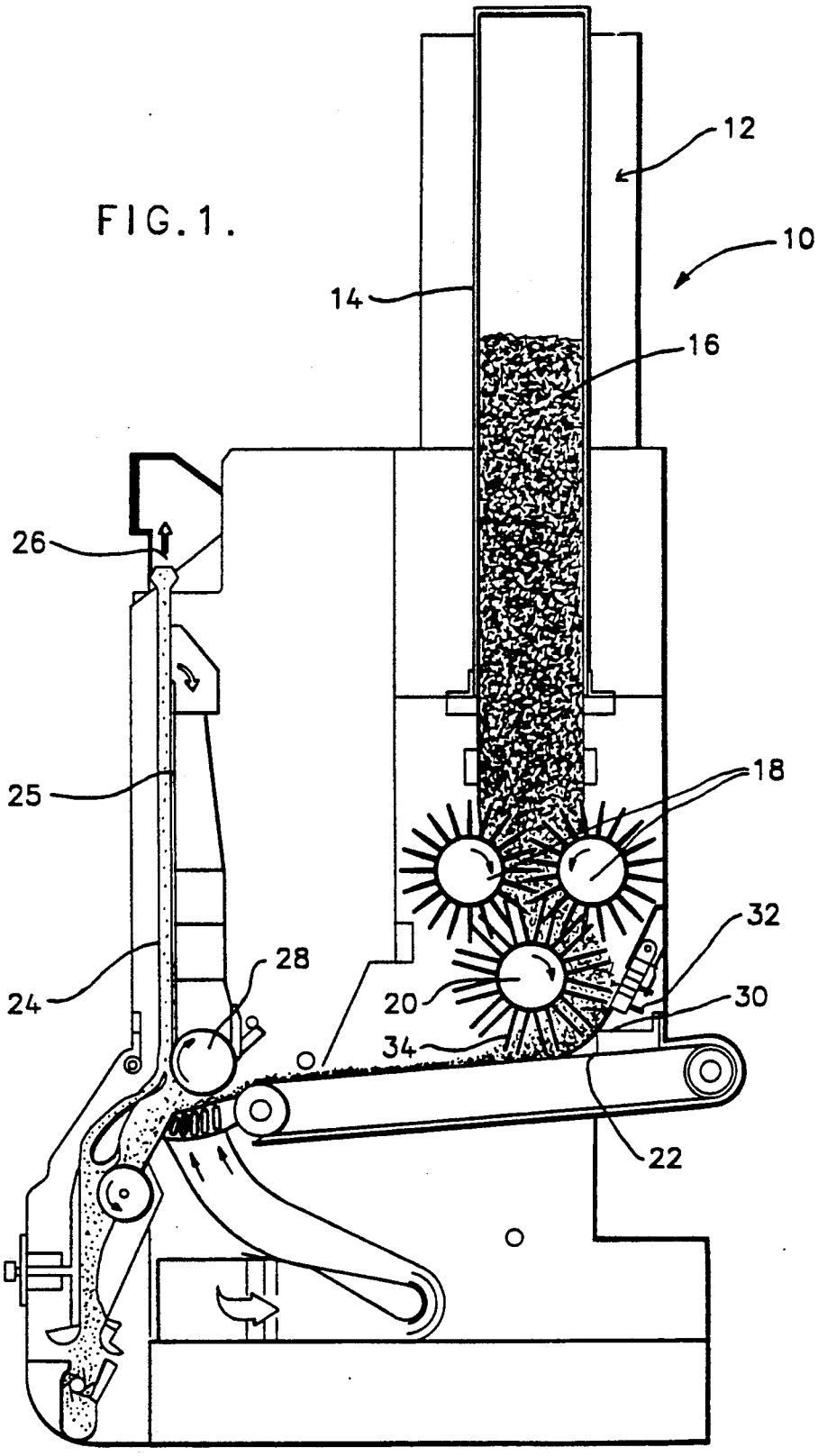
FIG. 1 is a schematic illustration of a cigarette making machine, modified in accordance with one embodiment of the present invention.

Referring first to FIG. 1 of the drawings, a cigarette-making machine 10 is provided in the form of a modified Molins Mark IX machine, in which the conventional hopper arrangement of the machine has been removed and replaced by a novel hopper arrangement 12. The hopper 12 comprises an upright rectangular reservoir 14 in which is housed cut tobacco 16 for feeding to rod formation.

Located at the lower end of the reservoir 14 and extending the full width of the reservoir 14 is a pair of metering rollers 18 which serves to meter tobacco from the lower end of the reservoir 14. The metering rollers 16 grip the tobacco column 16, feed it downward by generally radially-extending pins and retain it for opening. An opening roller 20 also is provided, located in operative relation to the metering rollers 18, to comb away tobacco particles from the leading edge of the metered flow by interaction of pins generally radially-extending from the surface of the opening roller and those of the metering rollers 18, thereby to separate the individual tobacco particles one from another and to deposit them on the upper surface of a conveyor belt 22 on which they are carried as a wide tobacco carpet to rod formation. In a typical operation, the metering rollers 18 rotate relatively slowly, of the order of only a few revolutions per minute (rpm), while the opening roller 20 rotates much more quickly, generally about 300 to 400 rpm.

The spacing, number and configuration of the pins on the metering rollers 18 and the opening roller 20, as well as the speed of the opening roller 20, are the parameters which establish the amount of opening action. The parameters are varied to provide the optimum compromise between openness and degradation.

The combination of the metering rollers 18 and the opening roller 20 may be provided in the form of rollers which are adjustable in their spacing and the degree of pin interlocking. This adjustability makes it possible to find the optimum set up, i.e. the best compromise between the benefits of more complete opening and the losses from increased tobacco degradation. This principle of the adjustable rollers to provide the optimum set up has broader application and is applicable to different types of tobacco material, whether cut lumina, final blend, wet or dry tobacco or long or short tobacco, as well as to fibrous masses of any form.

At the downstream end of the conveyor belt 22, the tobacco is contacted with an upward air flow which conveys the tobacco upwardly into a chute or chimney 24 as a thin shower of tobacco particles 25 which are gathered on a transversely-moving belt 26 as a tobacco filler rod or braid.

At the lower end of the chute 24, a winnowing roller 28 is provided to remove heavy undesired particles from the tobacco stream. It has been found that, if the conveyor belt is properly adjusted so that each tobacco particle which leaves the downstream end of the conveyor belt 22 is projected exactly tangentially to the winnower 28, then a much more efficient winnowing operation is obtained than is generally the case in a conventional Molins Mark IX machine. For example, while typically 1% of the tobacco feed is winnowed out in a Molins Mark IX machine and that winnowed tobacco contains approximately 50% of usable tobacco, by operating in the manner described above, i.e., by launching the tobacco from the end of conveyor 22 as a very accurately-aimed stream, about 4% of the tobacco feed is winnowed out containing approximately 10% of usable tobacco. This improved winnowing operation constitutes one aspect of the present invention.

As the tobacco particles are collected on the belt 26, the shorter tobacco particles have a chance to penetrate into the accumulating porous braid while the longer tobacco particles do not do so, which results in an excess of longer tobacco particles being exposed to and broken up by the subsequent trimming action. The returned trimmed tobacco preferably is isolated to the side of the hopper 14 that delivers tobacco to the lower surface of the braid as the braid leaves the shower 25, thereby decreasing the quantity of long tobacco exposed to the trimming and hence subjected to degradation by the trimming action.

In this rod-forming procedure, all refusing operations commonly employed in conventional cigarette-making machines are eliminated, so that all tobacco particles are carried forward from the reservoir 14 with their neighboring particles to the filler rod. This tobacco filler rod-formation procedure and equipment therefore generally have been described in the aforementioned U.S. Pat. No. 4,867,180.

In accordance with the present invention, a stationary concave plate 30 is provided for the opening roller 20 and over which the tobacco particles pass on their way from the metering rollers 18 to the conveyor 22. A plurality of static pins 32 is provided projecting through the concave 30 to engage the tobacco being conveyed by the opening roller. The static pins 32 are interspaced with the pins of the opening roller 20 and are arranged to provide a selective opening action to the tobacco particles passing over the concave plate 30.

Smaller particles by pass the static pins 32 and are not affected by them while any clusters of longer tobacco particles contact the pins 32, so that an additional opening action (further to that carried out by the opening roller 20) is carried out on those clusters. This additional opening action is applied only to the tobacco which needs it and is not applied to the particles that do not. The degree of additional opening action which is applied to the tobacco may be controlled by adjusting the clearance, or degree of overlap, between the static pins 32 and the pins 34 of the opening roller 20.

By providing for additional opening to a degree controlled by the cigarette manufacturer, the opening action of the machine may be configured to meet the individual circumstances and tobacco blends. This flexibility of operation has not hitherto been possible and is obtained with relatively simple additional hardware.

Another advantage provided by the use of the concave 30, whether or not the pins 32 are employed, is that the tobacco particles leave the concave 30 with a velocity component parallel to the fast-moving conveyor surface 22, which minimizes the distance required for the individual particles to settle down to conveyor speed. In this way, the conveyor has complete control over the particles prior to the downstream end of the conveyor, so that the particles can be individually and precisely aimed tangentially to the winnowing roller 28.

Figure 2:
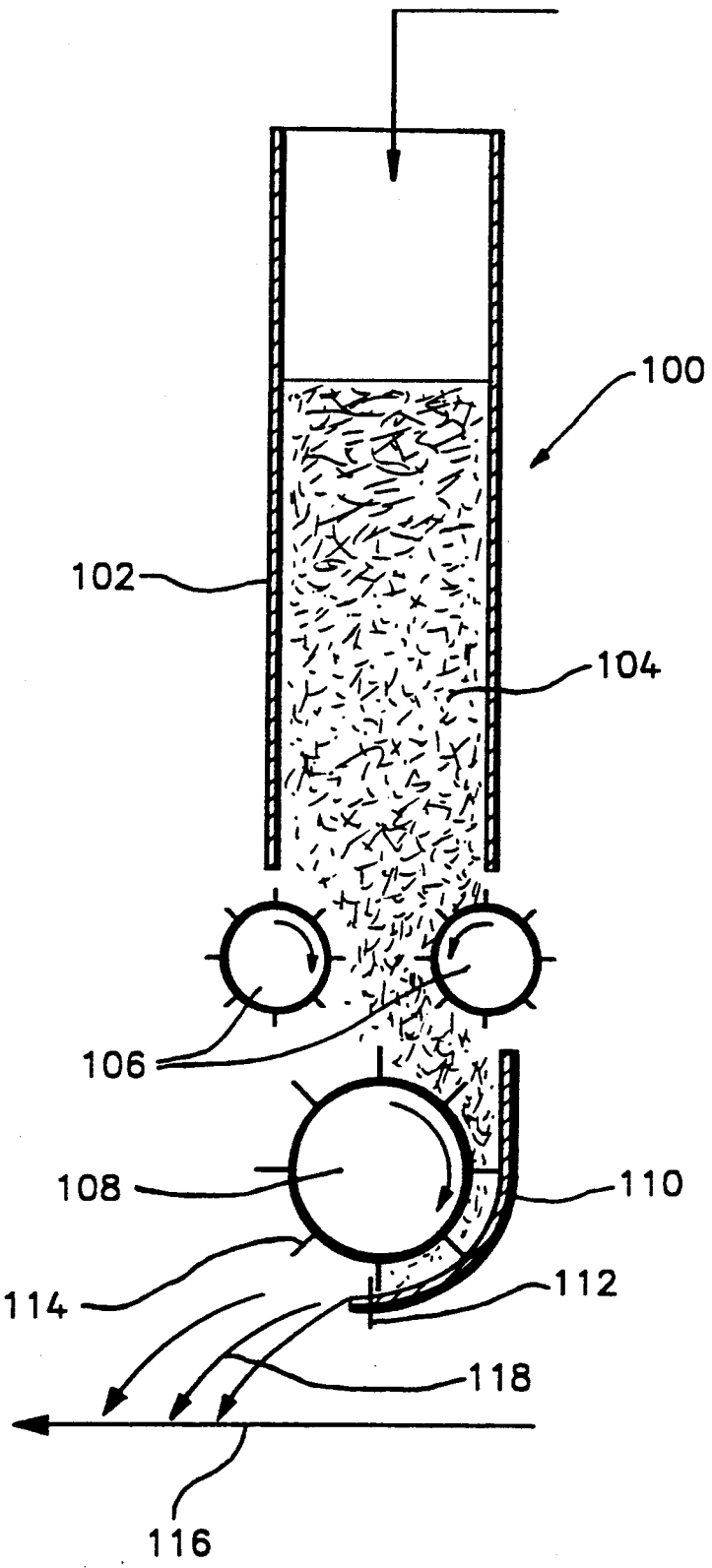
FIG. 2 is a schematic illustration of a procedure for preparing glass-fiber reinforced products, in accordance with another embodiment of this invention.

Referring now to FIG. 2, there is shown schematically therein a portion of an operation to effect opening of glass fibers for glass fiber reinforcement of liquid polymers to provide structural elements. The Glass-fiber reinforced structural elements are formed by distributing glass fibers in a liquid polymer matrix and curing or setting the polymer matrix to solid form. The glass-fibers provide reinforcement to the structural strength of the elements.

The apparatus 100 comprises an upright rectangular reservoir 102 in which is housed glass fibers 104 for processing. The glass fibers are received from an upstream location, which may include an initial metering and opening operation, to effect an additional opening of the intertangled mass of glass fibers which characterizes the initial feed material.

A pair of metering rollers 106 is located at the lower end of the reservoir 102 extending for the full width of the reservoir 102 which serves to meter glass fibers from the lower end of the reservoir 102. The rollers 106 grip the column 104 of glass fibers, feed it downward by the action of generally radially-extending pins and retain the feed for opening. An opening roller 108 is provided in operative relation to the metering rollers 106, to comb away glass fiber particles from the leading edge of the metered flow by the interaction of pins generally radially-extending from the surface of the opening roller 108 with those of the metering roller 106, thereby opening the metered flow of glass fibers and separating them one from another.

A stationary concave surface 110 is provided following the contour of the outer periphery of the roller 108 and a plurality of static pins 112 is provided adjacent the downstream end of the concave surface. The static pins 112 engage the glass fibers conveyed by the opening roller 108 over the concave surface 110 and applies an additional opening action to any bundles of glass fibers to ensure that all the metered glass fibers are separated one from another.

The stationary concave surface 110 is positioned as closely as practical to the pins 114 extending from the roller 108 so as to maintain the opened glass fibers under close control during passage from initial opening to discharge. This operation may be enhanced by providing grooves in the surface of the concave surface 110 into which the pins 114 extend.

At the downstream end of the concave surface 110, the glass fibers are projected generally horizontally outwardly in the direction of movement of a recipient conveyor 116 on which is supported a polymeric material, in liquid form to be reinforced by the glass fibers.

The roller 108 generally is rotated at such a speed that the glass fibers form a shower 118 of such particles which fall onto the polymeric material, which then is further processed, including rigidifying, to form a glass-fiber reinforced polymeric sheet. Such sheets may be employed to provide structural elements by molding, for example, automobile body parts.

In the shower 118, lighter glass particles tend to be projected further than heavier glass particles, so that an averaging of particle sizes occurs, providing a uniformity of distribution of glass fiber particles in the reinforced polymeric sheet.

SUMMARY OF DISCLOSURE

In summary of this disclosure, the present invention provides a novel manner of processing fibrous material and equipment therefor which permits controlled opening of the fibrous material to be effected in a manner to suit individual needs, as well as a novel tobacco winnowing procedure which enables improved winnowing efficiency to be attained. Modifications are possible within the scope of this invention.

What we claim is:

1. In a method of formation of an upwardly vertically-moving shower of tobacco particles for formation of a cigarette filler rod therefrom by conveying a wide carpet of substantially separated tobacco particles from a remote location, introducing said tobacco fibers to an upwardly moving gas stream to entrain substantially all said introduced tobacco fibers to form said shower conveyed by said upwardly-moving air stream, and winnowing undesirable heavy tobacco particles from said tobacco fibers in said carpet by a rotary winnowing device, the improvement wherein each of the tobacco fibers in said carpet is projected from the termination of said conveying step substantially tangentially to the surface of said rotary winnowing device, whereby an improved winnowing operation is effected to remove a greater proportion of said undesirable tobacco particles and a lesser proportion of the desired particles from said tobacco particle in said carpet.

2. The method of claim 1 wherein said wide carpet tobacco particles is conveyed on a generally horizontal rectilinear conveyor surface.

3. The method of claim 2 wherein said wide carpet of tobacco is formed from substantially opened tobacco particles delivered thereto.

4. The method of claim 2 wherein said substantially opened tobacco particles are delivered onto an upper conveying surface of said rectilinear conveyor with a horizontal component of motion.

5. The method of claim 4 wherein said substantially opened tobacco particles are delivered to said rectilinear conveyor from a source of cut tobacco particles contained in a vertical reservoir by metering said cut tobacco downwardly from said source thereof, opening said metered flow of cut tobacco particles to effect substantially complete separation of the individual tobacco particles one from another, and conveying said opened particles on a curved conveying surface to a point of discharge therefrom substantially parallel to said rectilinear conveyor while substantially retaining said opened condition.

6. Apparatus for opening fibrous material, which comprises:

reservoir means for holding a mass of fibrous material, a pair of metering rollers located adjacent an open lower end of said reservoir means for metering a flow of said fibrous material from said lower end of said reservoir means, opening roller means located in operative relationship with said pair of metering roller to effect opening of said metered flow of fibrous material to separate said fibers substantially completely one from another, and selective additional opening means located in operative relationship with said opening roller means to effect a further opening on a selected portion only of said opened fibrous material.

7. The apparatus of claim 6 wherein each of said metering rollers is provided with generally radially-projecting pins which interact for effecting said metering.

8. The apparatus of claim 7 wherein said opening roller means is provided with generally radially-projecting pins which interact with said radially-projecting pins on said metering rollers to effect said opening.

* * * * *